United States Patent [19]

Calco

[11] Patent Number: 4,648,658

[45] Date of Patent: Mar. 10, 1987

[54] COLLAPSIBLE CHAIR

[76] Inventor: Wayne Calco, 91 Bard Dr., Hudson, Ohio 44236

[21] Appl. No.: 733,753

[22] Filed: May 14, 1985

[51] Int. Cl.[4] ..... A47C 4/00

[52] U.S. Cl. ..... 297/440; 206/216; 297/16; 297/193

[58] Field of Search ..... 297/16, 17, 193, 440, 297/442; 211/195; 312/259; 248/152, 174; 206/216

[56] References Cited

U.S. PATENT DOCUMENTS

| | | | |
|---|---|---|---|
| 2,049,659 | 8/1936 | Parrott | 297/16 |
| 2,849,726 | 9/1958 | Vay . | |
| 3,178,227 | 4/1965 | Snyder . | |
| 3,220,362 | 11/1965 | Downes | 297/440 X |
| 3,312,503 | 4/1967 | Suzuki . | |
| 3,331,634 | 7/1967 | Harrison, Jr. | 297/442 |
| 3,556,593 | 1/1971 | Speegle . | |
| 3,606,459 | 9/1971 | Krone | 297/440 |
| 3,640,575 | 2/1972 | Dosi . | |
| 3,727,979 | 4/1973 | Schier et al. . | |
| 3,744,409 | 7/1973 | Bradbury, II | 297/193 X |
| 4,085,970 | 4/1978 | Klein . | |
| 4,340,251 | 7/1982 | Geoffroy-Dechaume . | |

*Primary Examiner*—Kenneth J. Dorner
*Assistant Examiner*—Peter R. Brown
*Attorney, Agent, or Firm*—Fay, Sharpe, Fagan, Minnich & McKee

[57] ABSTRACT

An article of furniture foldable into a flat state and made of stiff sheet material includes a plurality of substantially vertical base panels, connected at their lateral edges to form a base portion, and a seat panel which is integral with and hinged from at least one of the base panels along at least one hinge line. The seat panel is disposed substantially horizontally over the base portion while in use and is pivotable around the hinge line to a substantially vertical position when the article of furniture is folded. A spine portion is provided between two of the base panels for reinforcing the article and includes a pair of flanges which are secured to each other. A reinforcing member is disposed within the base portion and is secured to the spine for reinforcing the seat panel.

34 Claims, 9 Drawing Figures

COLLAPSIBLE CHAIR

BACKGROUND OF THE INVENTION

This invention generally pertains to articles of furniture. More specifically, the present invention relates to a collapsible and portable furniture item made from preformed blanks of sheet material or the like.

The invention is particularly applicable to a self-supporting chair structure made from preformed blanks of corrugated sheet material which can be easily and quickly assembled to produce a chair of sturdy yet inexpensive construction. However, it will be appreciated by those skilled in the art that the invention has broader applications and may also be adapted for use in other furniture items, such as stools, tables, benches and the like, as well as other structures, such as display bins, holders, containers, or similar items.

It is known in the prior art to fabricate chairs or other furniture items from one or more blanks of cardboard material. Such chairs in various structural forms and in various designs have been made for use as toys, for childrens' furniture, as well as for adult use. Because the cost of such a chair is so low, it may be disposed of after only a brief period of use.

While many different chair designs and similar structures have been suggested in the past, none of these has met with general acceptance or marketing success. One reason for this may be due, at least in part, to the relative complexity of prior art structures and to the difficulty in their set up or assembly at the point of use. Also, most conventional sheet material chairs are not sturdy enough to safely seat a full grown or a heavy person.

Moreover, most of the conventional cardboard chairs are not collapsible into a flat state both for initial transport or shipping to minimize costs and for refolding after use. Such portable collapsible chairs would be particularly advantageous for use at sporting events, such as golf tournaments, outdoor band concerts, air shows, and so on where conventional seating is not normally available. Sturdy yet inexpensive seating of the type mentioned would also be useful on camping trips, beach outings and the like.

Accordingly, it has been considered desirable to develop a new and improved collapsible chair made of sheet material which would overcome the foregoing difficulties and others while providing better and more advantageous overall results.

BRIEF SUMMARY OF THE INVENTION

In accordance with the present invention, a new and improved foldable article of furniture is provided, which is made of a stiff sheet material.

More particularly in accordance with the invention, the article of furniture includes a plurality of base panels connected at their lateral edges to form a base portion. A seat panel is integral with and hinged from at least one of the base panels along at least one hinge line. The seat panel is disposed in a substantially horizontal orientation over the base portion while in use and is pivotable around the hinge line to a substantially vertical orientation when the article of furniture is folded. A spine portion is provided between two of the base panels for reinforcing the article of furniture and includes a pair of flanges which are secured to each other. A reinforcing member is disposed within the base portion and is secured to the spine portion for reinforcing the seat panel.

According to another aspect of the invention, a new and improved chair made of stiff corrugated sheet material is provided.

More particularly in accordance with this aspect of the invention, the chair includes a base having a plurality of substantially vertically disposed panels comprising a front panel and a pair of side panels with which the front panel is integrally formed. A seat panel is integrally formed with opposing lateral ends of a top edge of the front panel. A respective hinge line is provided between each of the front panel top edge lateral ends and the seat panel. A slot separates the remainder of the seat panel from the front panel. The seat panel is disposed in a substantially horizontal orientation over the base while in use and is pivotable around the pair of hinge lines to a substantially vertical orientation when the chair is to be folded. A seat panel reinforcing member is positioned within the base and is secured thereto.

In accordance with still another aspect of the invention, a collapsible seat of stiff sheet material or the like is provided.

More particularly in accordance with this aspect of the invention, the seat includes a base member comprised of a plurality of substantially vertically disposed panels including a front panel and a pair of side panels such that the base member has a substantially triangular cross section. The front panel is integrally formed with the side panels. A spine portion is provided on the base at the area where the base member side panels are joined to each other. A seat panel is integrally formed with and hinged from a top edge of the front panel. The seat panel can be disposed in a substantially horizontal orientation over the base member for use and in a substantially vertical orientation to allow the seat to be folded. The seat panel is hinged along its middle so that it can be folded into two complimentary halves when the seat is folded. A seat reinforcing member which extends underneath and supports at least a portion of the seat panel when the seat panel is in the substantially horizontal orientation is also provided.

An advantage of the present invention is the provision of a new and improved self-supporting portable structure which is made from inexpensive sheet material and which can be carried in a folded or collapsed condition and unfolded for use. The structure can be reused, if desired, or discarded after its initial use due to its low cost.

Another advantage of the invention is the provision of such a self-supporting structure in the form of a chair which possesses unusual strength and stability due to its wide seat panel, reinforcing spine and seat reinforcing member and is yet of a surprisingly simple, economical and lightweight construction.

Still another advantage of the present invention is the provision of a chair having a base member made of a plurality of substantially vertically oriented panels and a seat panel which is integrally formed with and hingedly connected to at least a portion of a top edge of at least one of the base member panels. The seat panel can be pivoted around its hinged connection between a substantially horizontal position over the base member for use and a substantially vertical position to allow the chair to be folded.

Yet another advantage of the invention is the provision of a collapsible chair which has a reinforcing spine member and support means secured to the spine for bracing a seat panel of the chair.

Yet still another advantage of the invention is the provision of a collapsible chair which can be folded to a thin configuration and which is provided with hand-hold apertures for easy transport of the chair in the collapsed condition.

Still yet another advantage of the invention is the provision of a chair having a wide seat panel which can be pivoted around a pair of spaced hinge lines provided on flanges extending from opposed lateral ends of a front panel of a seat base portion. The flanges are disposed at opposed angles with respect to the remainder of the front panel and the pair of hinge lines are disposed at opposing angles with respect to a horizontal plane passing through the seat panel.

Yet a further advantage of the invention is the provision of a chair which can be provided with a plurality of spaced slots on its base and on its reinforcing member. These slots are adapted to cooperate with an associated plastic bag which can be placed under the chair's seat panel to retain items, such as canned soft drinks and ice, for example.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENTS

Figure 2:
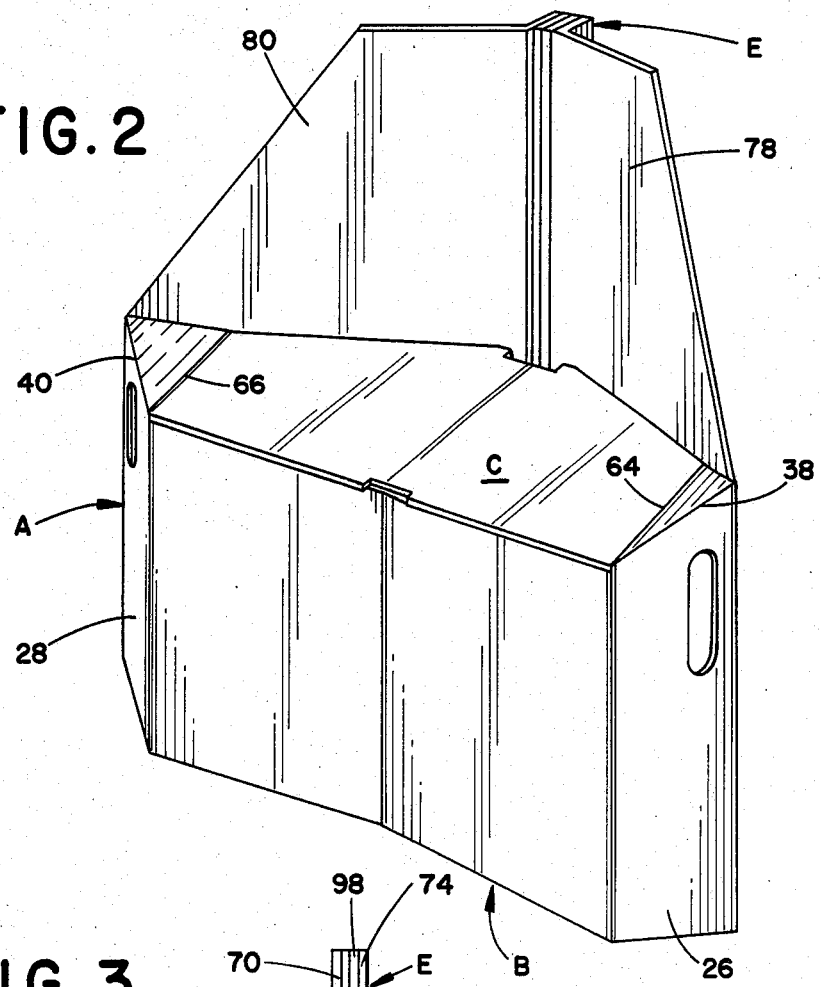
FIG. 2 is a perspective view in enlarged scale of the collapsible chair of FIG. 1 folded together and secured such that the chair is ready for use.

Referring now to the drawings, wherein the showings are for purposes of illustrating preferred embodiments of this invention only and not for purposes of limiting same, FIG. 2 shows the subject new article of furniture as a collapsible chair A. While the article of furniture is primarily designed for and will hereinafter be described as a collapsible chair, it will be appreciated that the overall inventive concept involved could be adapted for use in other self-supporting foldable furniture environments as well.

Figure 1:
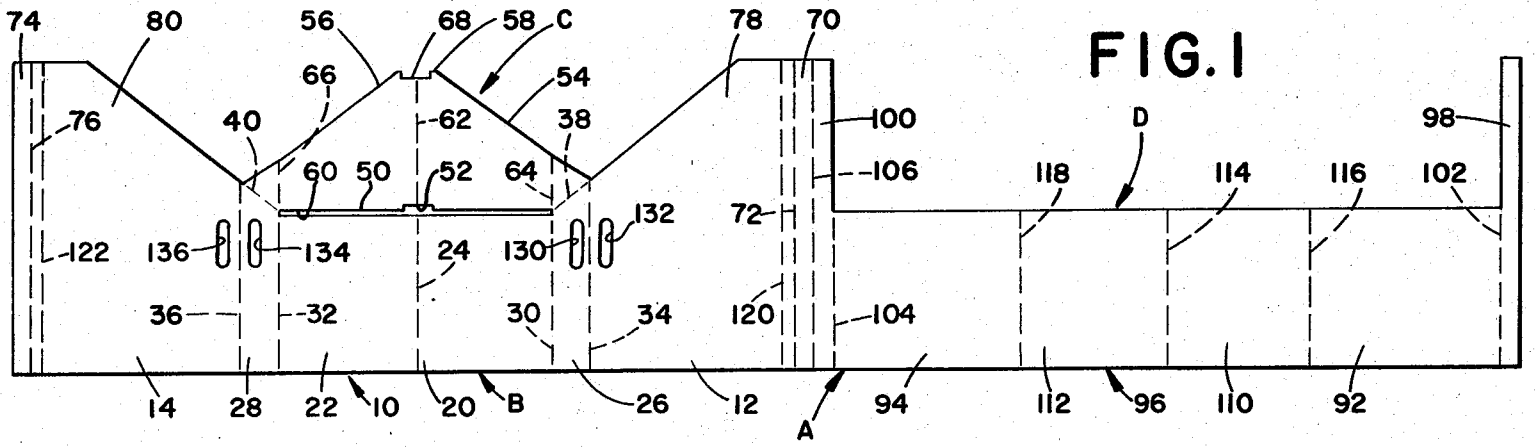
FIG. 1 is a top plan view of a blank of sheet material which can be formed into a collapsible chair according to a first preferred embodiment of the present invention.

More particularly, and with reference now also to FIG. 1, a first preferred embodiment of the collapsible chair of the present invention includes an integral blank of sheet material having a base member B, a seat member C and a reinforcing member D. The base member B includes a front panel 10, and first and second side panels 12, 14, which are integrally formed therewith and extend from opposing lateral edges thereof.

The front panel 10 is divided into first and second sections 20, 22 by a fold line or hinge 24 along its middle. Disposed on the opposing lateral edges of the first and second sections 20, 22, are first and second flange portions 26, 28, each of which is integral with its respective panel half and separated therefrom along respective first fold lines 30, 32. The flange portions 26, 28 are also integral with their respective side panels 12, 14 and each is separated therefrom along respective second fold lines 34, 36.

Also, respective top fold lines 38, 40 separate the flange portions 26, 28 from the seat member C. These fold lines 38, 40 are preferably angled with respect to a horizontal plane passing through the front panel 10. It has been found that a 45° angle is advantageous, but, of course, any desired angle could be used. Also, when the chair A is assembled for use, the flange portions 26, 28 are angled with respect to the front panel 10 by approximately 30° as may be seen from FIG. 3. The seat member C is somewhat triangular in shape and includes a front wall 50, which is provided with a notch 52 therein, as well as first and second side walls 54, 56 and an abbreviated back wall 58. A slot 60 is located between the seat front wall 50 and the first and second sections 20, 22 of the front panel 12.

Thus, the seat member or panel C is only connected to the base front panel 10 at the first and second flanges 26, 28 along fold lines 38, 40 with the slot 60 separating these two components elsewhere as mentioned previously. The above mentioned geometry of the front panel flanges 26, 28 cooperates with the construction of the seat panel C to provide a chair in which the seat panel is easy to move from the horizontal position to the vertical position when the chair is ready to be collapsed. The slot 60 has been found to be advantageous since it allows the seat panel 50 to be readily folded onto the base portion 10 and also allows the front panel 12 to underlie at least a portion of the seat panel C, along the fold line 24, to provide more reinforcement therefor.

A fold line 62 is provided along the middle of the seat portion C to allow the seat portion to be folded into two complimentary halves when the chair is collapsed. Secondary fold lines 64, 66 are also provided on the seat member C adjacent the flange portion top fold lines 38, 40. In the seat panel's vertical position, the secondary fold lines 64, 66 preferably extend substantially vertically and in line with the flange portion fold lines 30, 32. When the seat panel C is in the horizontal position, the secondary fold lines are disposed substantially horizontally and the panel material is folded along both sets of fold lines 38, 40 and 64, 66 as is evident from FIG. 2. Defined between the respective sets of fold lines 38, 64 and 40, 66 are respective triangular portions of the seat panel C which are disposed at opposing angles to a horizontal plane passing through the remainder of the seat panel when it is positioned over the base B such that the chair A is ready for use.

The notch 52 is advantageous in helping to manipulate the seat panel C from a vertical position when the chair is folded to a horizontal position when the chair is in use. Also, a rear notched portion 68 can be provided on the rear surface 58 to enable the seat portion to be easily moved from its horizontal orientation to its vertical orientation.

Extending from a free edge of the first side panel 12 is a flap 70 which is joined to the side panel by a hinge or fold line 72. Similarly, a second flap 74 extends from a free edge of the second side panel 14 and is integral therewith but can be disposed at an angle thereto by being bent along a fold line or hinge line 76. When the two flaps 70, 74 are bent along their respective fold lines 72, 76, they constitute flanges which are part of a reinforcing spine E for the chair A (see FIG. 3).

Figure 4:
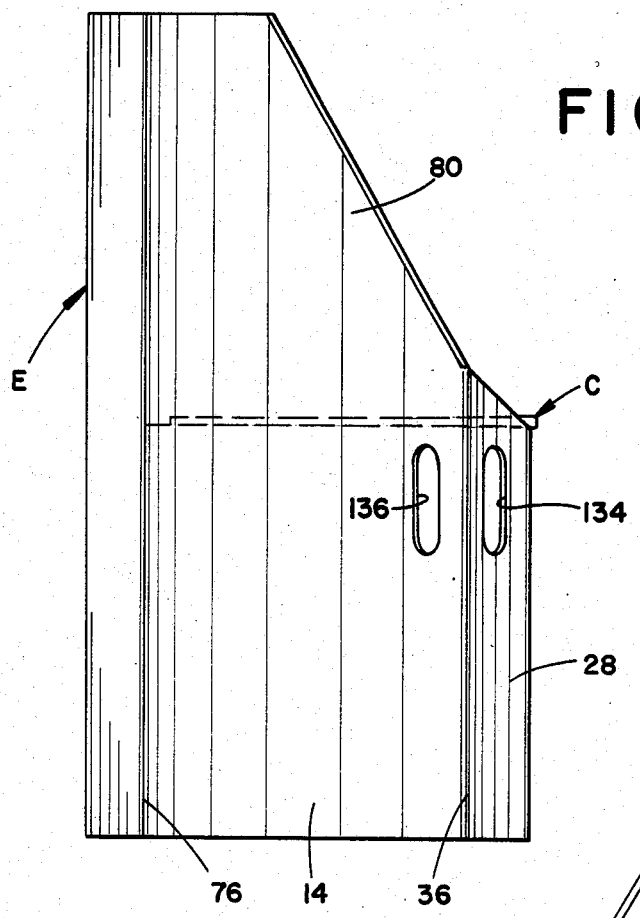
FIG. 4 is a side elevational view of the chair of FIG. 2.

Preferably, a pair of lower back support panels 78, 80 are integrally formed with a respective one of the first and second side panels 14, 16 and extend upwardly therefrom so that they are disposed above the seat panel C when it is folded down for use along fold lines 38, 40 as shown in FIG. 4. Of course, the chair could be used even if no lower back support panels were provided, if that were considered desirable. Indeed, it may well be that for certain applications a portable collapsible seat which is not provided with lower back support panels would be preferable.

The integral reinforcing member D includes first, second and third panels 92, 94, 96 which are disposed in a substantially vertical orientation when the chair is in use. The first and second panels 92, 94 have extending therefrom respective flap portions 98, 100 which are separated from the first and second reinforcing panels 92, 94 along respective hinge lines or fold lines 102 and 104. Only a fold line 106 separates the second flap 100 of the reinforcing member D from the first side panel flap 70 of the base member C.

The third panel 96 is separated into two halves 110, 112 along a central fold line 114. A lateral edge of each half portion 110, 112 is integral with a respective one of the first and second panels 92, 94 but is separated therefrom along a respective hinge line or fold line 116, 118.

Figure 3:
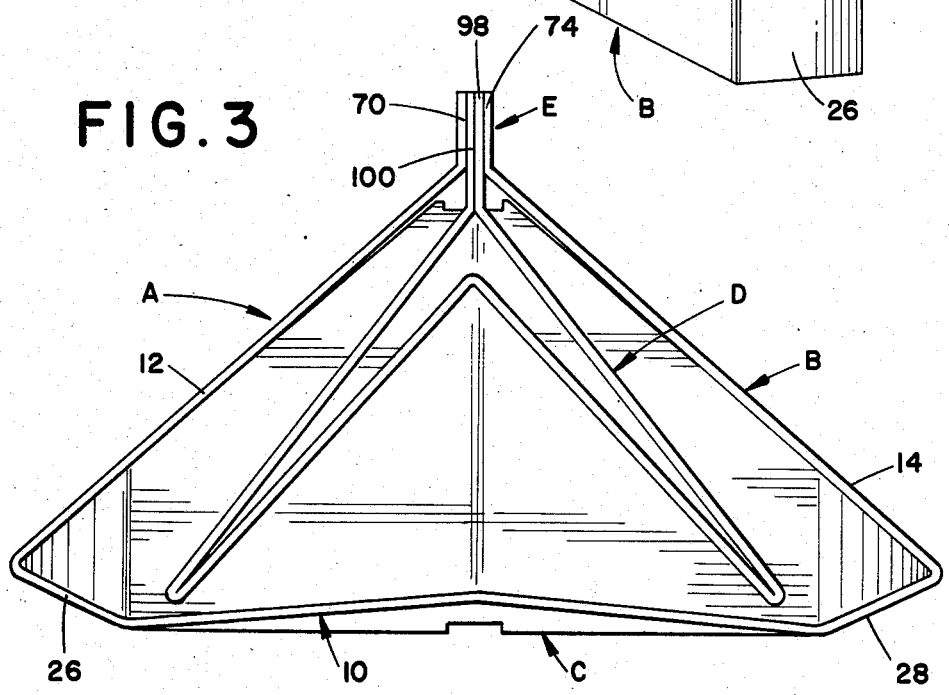
FIG. 3 is a bottom plan view of the chair of FIG. 2.

With reference now to FIG. 3, the chair A, when assembled, has a reinforcing spine E which includes the reinforcing member flaps 98, 100 and the side panel flaps 70, 74. Thus a four-ply construction is obtained for the spine E and this makes for a sturdy chair. Since the spine E is located between the back support panels 78, 80, as is evident from FIG. 2, the chair also has a strong back support section.

Figure 5:
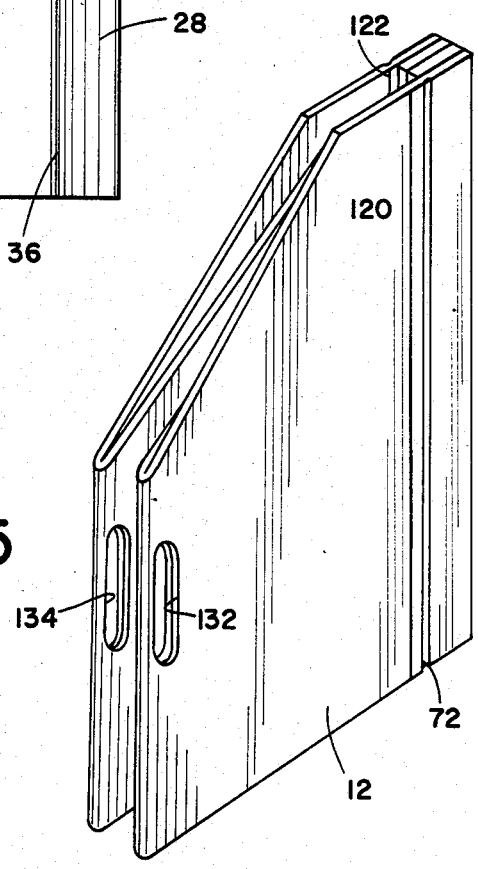
FIG. 5 is a perspective view of the chair of FIG. 2 in a collapsed condition.

When the chair is folded or collapsed, as shown in FIG. 5, the material is four layers thick in the spine E but eight layers thick in the area of the reinforcing member D. In order to prevent any cracking of the panel material in the side panels 12, 14 of the base portion, additional fold lines 120, 122 are preferably provided in the two side panels 12, 14 near the vicinity of the flap fold lines 72, 76. These additional fold lines 120, 122 serve to take up stress on the material when the seat is collapsed.

Handle defining apertures 130, 132, 134, 136 may be provided in each of the side panels 12, 14 and a respective adjoining front panel flange portion 26, 28. This allows for easy portability of the collapsible seat structure in its collapsed condition since the handle defining apertures are located next to each other so that one's fingers can extend therethrough as is evident from FIG. 5.

When collapsed, the chair A is thin in cross section so that it is easy to carry and does not take up much space if stacked. In order to collapse the chair A, the seat panel C is flipped up to its vertical position pivoting around the fold lines 38, 40 and 64, 66 in relation to the base portion B. Subsequently, the seat panel and base portion front panel 12 are pushed back against the spine E. This action will also fold the seat panel into two complimentary halves around the central fold line 62 and fold the base portion front panel into two complimentary halves 20, 22 around the central fold line 24. At the same time, the angle between the two side panels 12, 14 also decreases until the two halves of the seat panel contact each other and the two sections of the base member front panel 20, 22 contact each other. Also, the reinforcing member third panel 96 is folded along its central fold line 114 into two complimentary halves with the sections 20, 22 of the seat front panel becoming positioned between the halves 110, 112 of the reinforcing member third panel.

In one preferred embodiment, the chair A stands approximately 33 (84) inches (cm.) high at the spine D and the seat member C is located approximately 17 (43) inches (cm.) above the ground when in use. The chair has a depth of approximately 26 (66) inches (cm.) and a width at the front of the seat member C of approximately 26 (66) inches (cm.) when in use. In a collapsed condition, however, the chair A is only approximately 2 (5) inches (cm.) in width.

One suitable method of making the chair A includes punching or cutting it out of a suitable sheet material and providing it with the requisite scored fold lines. Subsequently, the several panels are folded to the correct shape. At this point, the first reinforcing member flap 98 can be brought adjacent the side panel flap 74 and they can be joined and secured to each other by a suitable means, such as a conventional adhesive or conventional fasteners.

Figure 6:
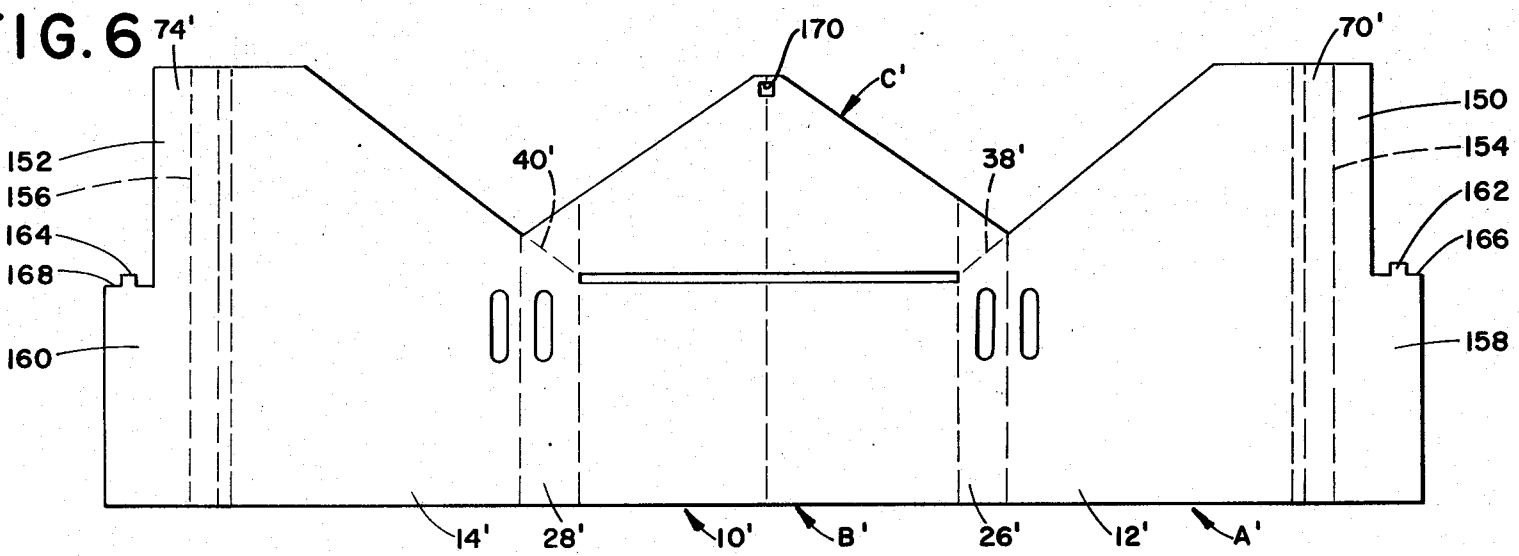
FIG. 6 is a top plan view of a blank of sheet material which can be folded to form a collapsible chair according to a second preferred embodiment of the present invention.

With reference now to the alternate embodiment of FIG. 6, the invention is there shown in a chair which is provided with a different type of seat reinforcing arrangement. For ease of illustration and appreciation of this alternative, like components are identified by like numerals with a primed (') suffix and new components are identified by new numerals.

In FIG. 6, a chair A' is provided with a base member B' which includes a front panel 10' as well as a pair of side panels 12', 14'. The chair also includes an integral seat member C' which can be maneuvered from a substantially vertical position to a substantially horizontal position along a pair of top fold lines 38', 40' defined on a pair of flaps 26', 28' provided on the front panel 10' adjacent a respective one of the side panels 12', 14'. In this embodiment, however, a seat reinforcing portion is provided by a pair of support flaps 150, 152 which are integral with a pair of side panel flaps 70', 74'.

Serving to separate the support flaps 150, 152 from the side panel flaps 70', 74' are respective fold lines 154 and 156. The support flaps 150, 152 each have a respective reduced height portion 158, 160 which is sized to be a height substantially corresponding to the height at which the seat member or panel C' will extend when in its horizontal orientation. Tabs 162, 164, respectively, extend upwardly from a respective dupper surface 166, 168 of each of the support flap reduced height portions 158, 160. These tabs are meant to fit inside a corresponding aperture 170 provided in the seat member C' to secure the seat panel in place on the support flaps.

It is evident that since the support flaps do not extend very far underneath the seat member C', a stiffer sheet material is required for this embodiment of the invention. It is also evident, however, that the basic structure of the seat disclosed in the embodiment of FIG. 6 is, except for the reinforcing arrangement, substantially identical with the seat structure disclosed in FIGS. 1–5. It should be recognized that other suitable reinforcing arrangements could also be provided for the seat panel.

Figure 7:
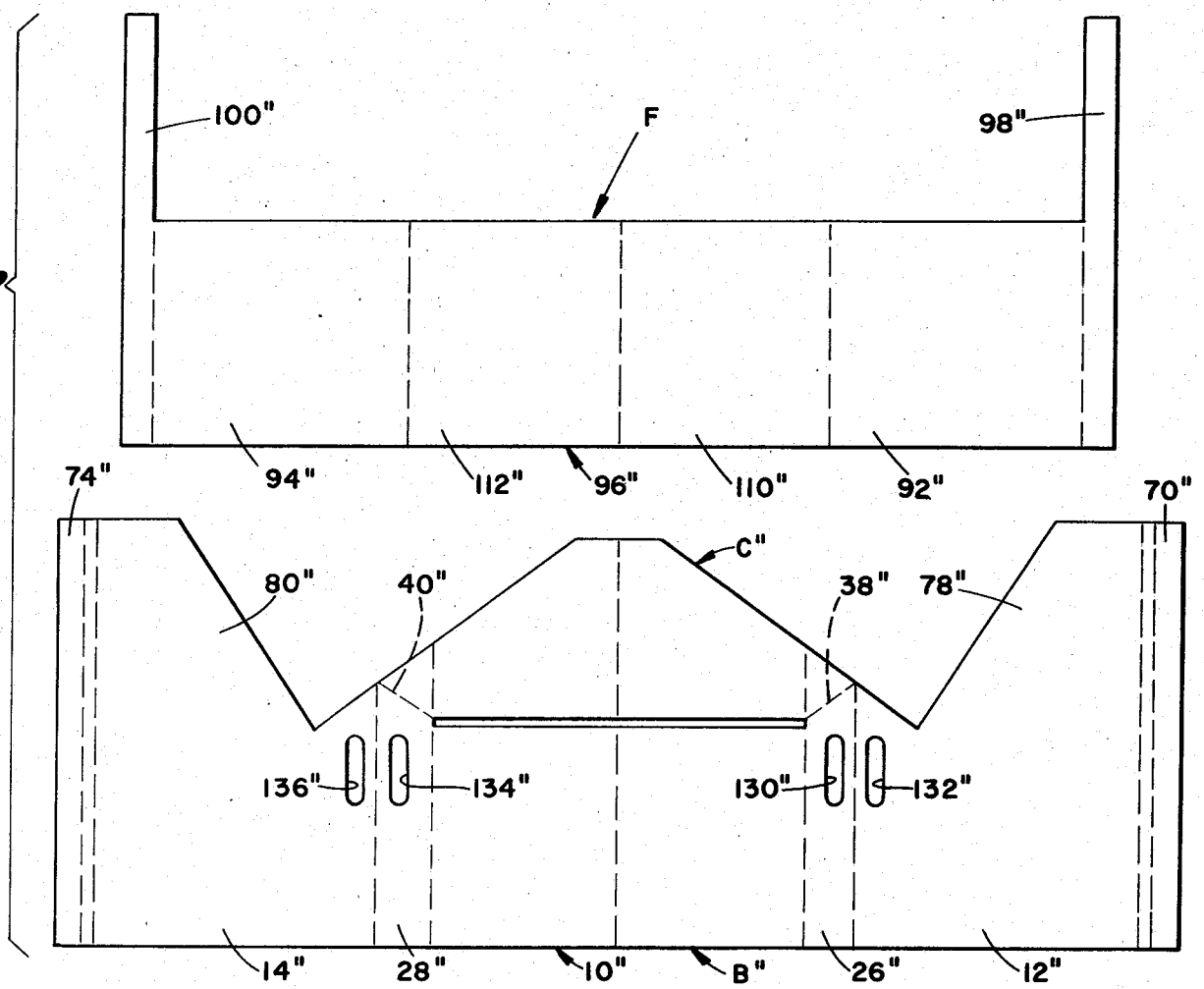
FIG. 7 is a top plan view of two blanks of sheet material which can be folded to form a collapsible chair according to a third preferred embodiment of the present invention.

With reference now to FIG. 7, it can be seen that the chair could also be made out of two or more separate sheets of material. For ease of illustration and appreciation of this alternative, like components are identified by like numerals with a double primed (") suffix, and new components are identified by new numerals.

In this FIGURE, the chair includes a base portion B" and a seat portion C" which are integral. The base portion B" again includes a front panel 10" as well as first and second side panels 12", 14" which are integrally formed therewith. The seat panel C" is separated from flange portions 26", 28" of the base portion front panel 10" along respective fold lines 38", 40".

In this embodiment, as well, the chair is provided with a pair of lower back support panels 78", 80" which are integrally formed with a respective one of the first and second side panels 12", 14" and extend upwardly therefrom so that they are disposed above the seat panel C" when it is folded down for use. On the other hand, however, it should be evident that the chair could also be made without the use of such lower back support panels 78", 80" if that were thought desirable.

In this embodiment, however, a separate reinforcing member F is provided. As with the embodiment of FIGS. 1–5, the reinforcing member F includes first, second and third substantially upright panels 92", 94", 96". The third panel can again be separated into two halves 110", 112" along a central fold line 114".

The reinforcing member F has elements which are part of a spine of the chair. The spine includes a pair of flaps 70", 74' which are integral with the first and second side panels 12", 14" of the chair as well as a pair of flaps 98", 100" which are integral with the reinforcing member F. As with the embodiments of FIGS. 1–5 and 6, it can be seen that when the chair is constructed, the spine will include four adjacent layers of material 70", 74", 98", 100" which are secured to each other in a suitable conventional manner.

Figure 8:
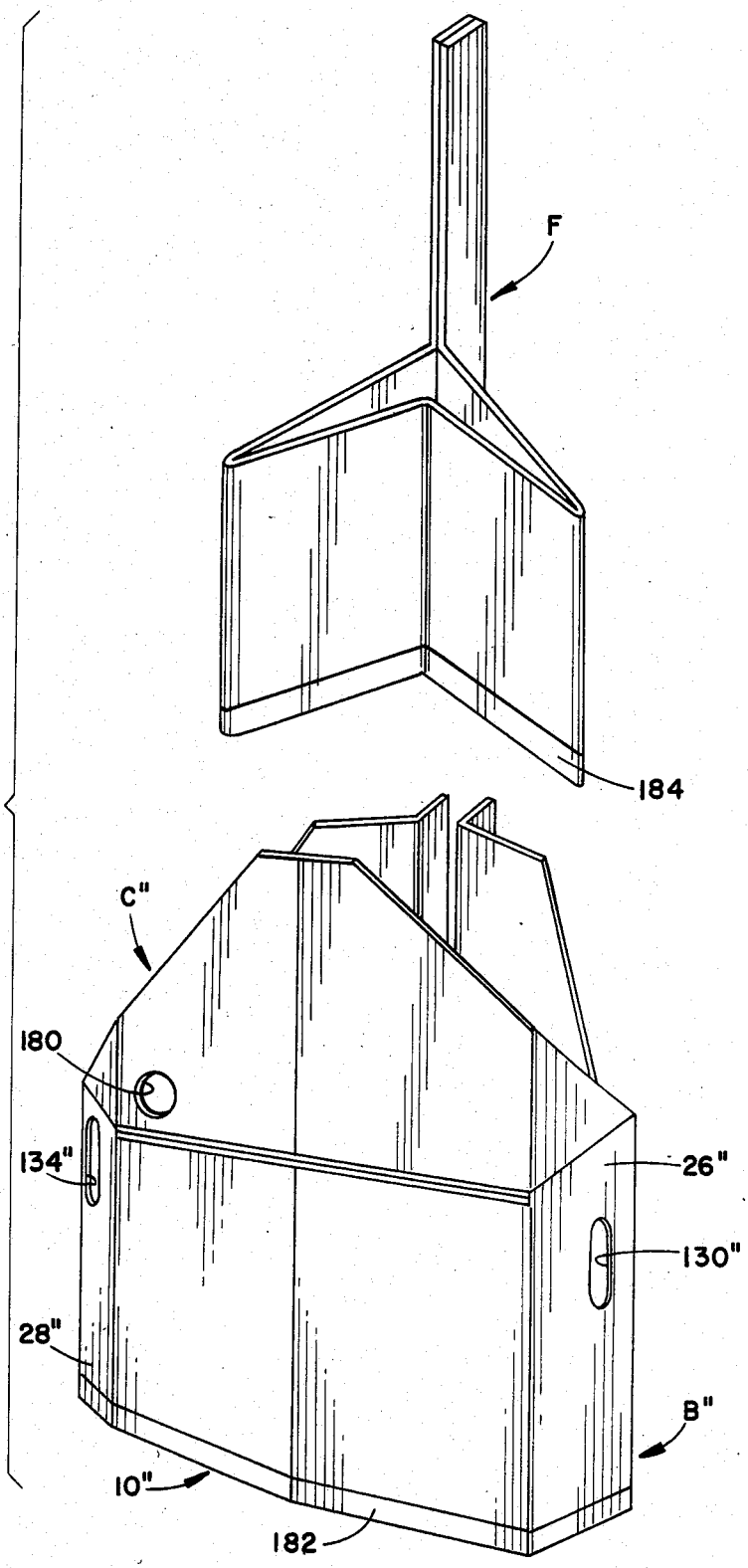
FIG. 8 is an exploded perspective view in enlarged scale of a base and seat portion and a reinforcing portion of the collapsible chair of FIG. 7 which have been folded and are ready to be secured together; and, FIG. 9 is a perspective view with portions cut away of a chair according to FIG. 2 which has been provided with a storage compartment.

With reference now to FIG. 8, the separate reinforcing member F and the integral base member B" and seat member C" can be suitably folded and then secured to each other by adhesive, fasteners or the like. If desired, handle apertures 130", 132", 134", 136" can be provided in each of the side panels 12", 14" and a respective adjoining front panel flange portion 26", 28".

Since the chair has a wide seating area, a substantially circular aperture 180 (as shown in FIG. 8) can be provided in the seat panel 50, if desired, to hold a conventional disposable tapered beverage cup (not illustrated) of the type usually formed of paper or plastic. Also, if the chair is made of corrugated cardboard or the like, the bottom of the chair can be dipped in a suitable conventional wax to form a water resistant zone 182, 184 on the base and seat portion and on the reinforcing portion F, respectively. The wax can fill the flutes in the corrugated cardboard to make the chair bottom waterproof.

It should be recognized that suitable additional features may also be provided for the chair. Among these features, for example, could be forming the chair such that it is angled backwardly in order that it would always be in a reclining position. This could be advantageous for sunning at the beach and the like.

One particular example of this kind of a construction would provide a chair which has a reinforcing spine only 25 inches in height as opposed to the normal 33 inches. In order to accomplish this, a triangular piece of the chair could be cut off with the apex of the triangle being along the spine portion. In this way, the chair when positioned on a surface would always be in a somewhat reclining orientation.

Alternatively, the chair could also be made such that it is in a somewhat forward angled orientation by removing a triangular piece from the base member such that the apex of the triangular piece is along the front panel 10. This could be advantageous for lawn concerts and the like.

Figure 9:
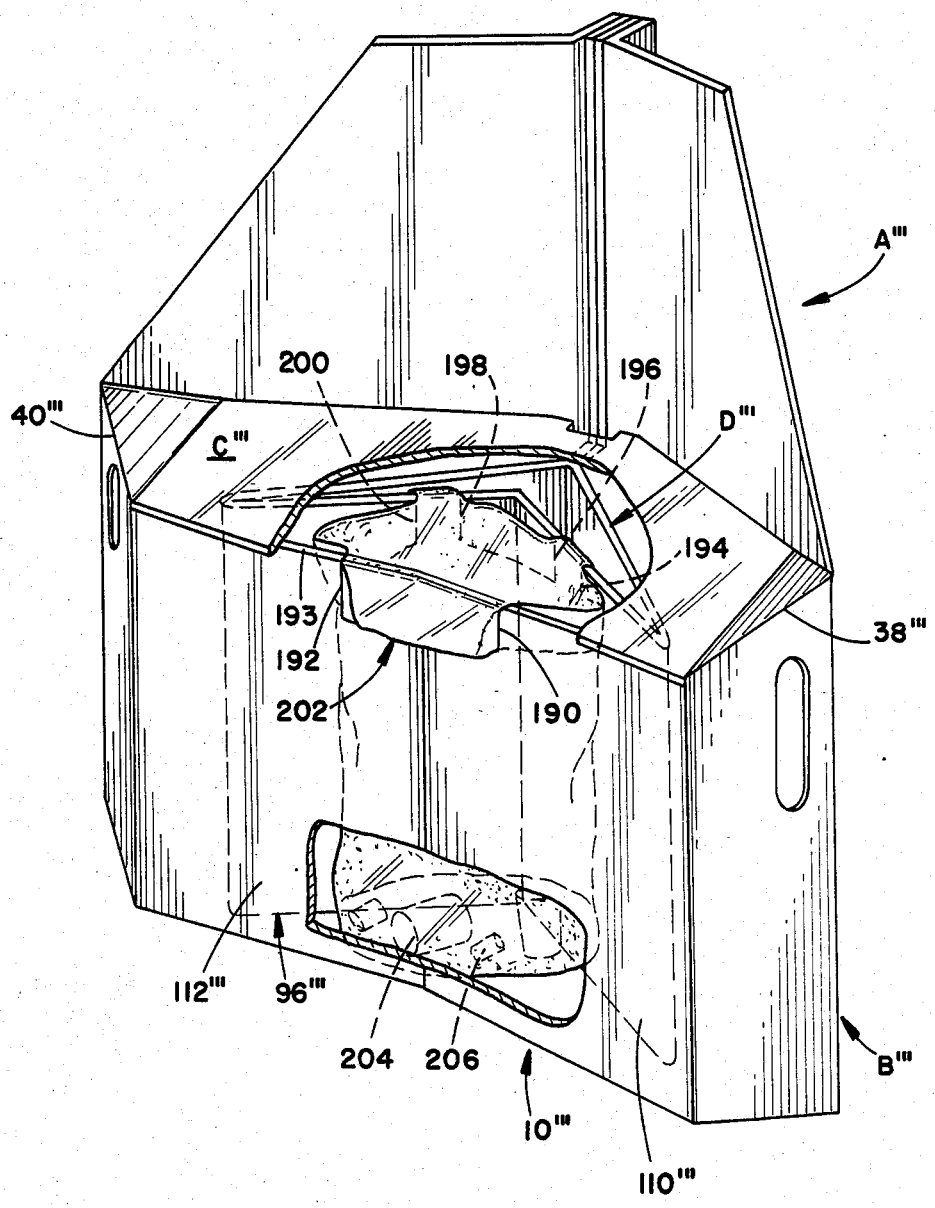

With reference now to FIG. 9, an article of furniture could be formed to also serve as a storage bin for items such as cold drinks and the like. For ease of illustration and appreciation of this alternative, like components are identified by like numerals with a triple primed (''') suffix and new components are identified by new numerals.

In this FIGURE, a chair A''' is provided with a base member B''', a seat member C''' and a reinforcing member D'''. A front panel 10''' of the base member is provided with a pair of spaced slots 190, 192 extending from its upper surface 193 toward the ground. Also, each half 110''', 112''', of a center panel 96''' of the reinforcing member D''' is provided with a pair of spaced slots 194, 196, 198, 200 extending downwardly from its respective upper surface. A suitably sized plastic bag 202 can be draped over the base member front panel 10''' and the reinforcing member center panel 96''' so that the open edge of the bag is secured in the above-mentioned slots.

The bag 202 may then be used to hold beverage cans 204 which can be cooled by ice cubes 206 or the like. Alternatively, the bag could be used as a trash receptacle or the like. To obtain acess to the bag 202, the occupant of the chair need merely stand up and flip up the seat panel C''' by rotating the panel around a pair of spaced hinge lines or fold lines 38''', 40'''. Since the bag is protected from the sun on all sides, by the chair A''' and the ground, drinks can be maintained cold for a reasonable length of time.

The chair of the present invention can be made in varying sizes to provide seating for children as well as adults. Also, the chair can be made in miniature size for use as a toy by children.

Although in general it is preferable to use corrugated paperboard or a corrugated plastic sheet material, it will be recognized that other suitable and readily available sturdy sheet materials, such as cardboard, plastic or metal sheets, laminated and stiffened cloth, composite sheet materials or the like could be used. It is evident that the type of material employed will depend to a considerable extent upon the size and end use of the resultant structure.

A chair according to the present invention could also be made of separate rigid sheets or panels of a material, such as plywood or plastic, with the panels of material being hinged together by flexible joints along the fold lines represented in the drawings. Of course, such a chair would be considerably more expensive than a chair made of paperboard or the like.

If the chair is made of cardboard or paperboard, it will generally have a rather limited service life since it suffers from wear and tear in time due to repeated stressing and impacts. But such a chair can be discarded when necessary since it is inexpensive and cardboard is biodegradable. On the other hand, if the chair is made from a plastic-type material, or a composite material, the chair can be used for an extended period of time since its service life can be comparable to that of any conventional piece of furniture.

The chair of the present invention is economical and easy to mass-produce by stamping it out of sheet material. Also, the chair is very compact and particularly light when made out of cardboard which makes it easy to transport when folded. The chair can also provide an excellent advertising medium since it has large flat surfaces suitable for displaying advertisements and its moderate production cost permits distribution in very large quantities.

The present invention therefore discloses a support structure in the form of a chair possessing unusual strength, stability and durability and yet having a surprisingly economical and lightweight construction which can also be rapidly assembled. The chair can be advantageously folded when not in use and quickly unfolded for use.

It should also be recognized that the present invention could be adapted for use in various other types of lightweight self-supporting foldable structures, such as stools, tables, benches, display bins, holders, containers, or the like.

The invention has been described with reference to preferred embodiments. Obviously, modifications and alternations will occur to others upon the reading and understanding of this specification. It is intended to include all such modifications and alterations insofar as they come within the scope of the appended claims or the equivalents thereof.

Having thus described the invention, it is now claimed:

1. A foldable article of furniture made of stiff sheet material, comprising:

a plurality of base panels connected at their lateral edges to form a base portion;

a seat panel which is integral with and hinged from at least one of said base panels along a pair of spaced hinge-like sections each of which is defined by a pair of hinge lines, a first hinge line extending between said seat panel and said hinge-like section and a second hinge line extending between said at least one base panel and said hinge-like section, said seat panel being disposed in a substantially horizontal orientation over said base portion while in use and being pivotable around said hinge-like sections to a substantially vertical orientation when the article of furniture is to be folded;

a spine portion provided between two of said base panels for reinforcing the article of furniture and including a pair of flanges which are secured to each other, said flanges being, respectively, integral with one of said base panels and being secured to each other in an overlying relationship; and, a reinforcing member disposed within said base portion and secured to said spine portion for reinforcing said seat panel.

2. The article of furniture of claim 1 wherein said seat panel is integrally formed with and connected to a top edge of a front panel of said base portion at least along said pair of spaced hinge-like sections.

3. The article of furniture of claim 2 wherein said base portion front panel has integral therewith first and second flanges which are disposed at opposing angles with respect to the remainder of said front panel, and wherein a respective one of said hinge-like sections is disposed adjacent to a respective one of said first and second flanges.

4. The article of furniture of claim 1 wherein said base portion comprises three substantially vertically oriented base panels including a front panel and a pair of side panels so that said base portion has a substantially triangular configuration in cross section.

5. The article of furniture of claim 4 wherein said front panel includes two sections which are hingedly connected so that they can pivot with respect to each other when the article of furniture is folded and wherein said front panel sections are slightly angled with respect to each other when said seat panel is in use so that a portion of said front panel can extend underneath said seat panel to provide further support therefor.

6. The article of furniture of claim 1 further comprising a pair of lower back support panels, one extending from and being integral with each of two adjacent base panels, said spine portion extending upwardly between said lower back support panels.

7. The article of furniture of claim 1 wherein said reinforcing member includes at least two substantially vertically oriented panels, said member extending from said spine to a position underneath said seat panel.

8. The article of furniture of claim 7 wherein said reinforcing member includes first and second panels which are disposed at an angle with respect to each other, and a third panel connecting said first and second panels.

9. The article of furniture of claim 8 further comprising a first pair of spaced slots provided in a front base panel and second and third pairs of spaced slots provided in said seat reinforcing member third panel, said first, second and third pairs of slots being adapted to cooperate with an associated plastic bag thereby allowing objects to be held inside the article of furniture.

10. The article of furniture of claim 7 wherein opposing lateral ends of said reinforcing member include flange portions which are secured to said spine portion such that said spine portion has a thickness of four panels of material.

11. The seat structure of claim 1 wherein said reinforcing member includes first and second support flaps which extend underneath a portion of said seat panel and further comprising locating means provided on said seat panel and said pair of support flaps for correctly positioning said seat panel on said pair of support flaps.

12. The article of furniture of claim 1 wherein said base portion, said seat panel, said spine portion and said seat reinforcing member are integral and are defined by a single pre-stamped and scored blank.

13. The article of furniture of claim 1 further comprising at least one handle aperture provided in said base portion for carrying the article of furniture when it is in a folded condition.

14. The seat of claim 1 wherein said hinge-like sections are substantially triangular in shape and are disposed at opposing angles to said seat panel when said seat panel is disposed in said substantially horizontal orientation.

15. A foldable chair made of stiff sheet material, comprising:

a base including a plurality of substantially vertically disposed panels comprising a front first panel and a pair of side second and third panels which are integrally formed with said first panel, one on either side thereof;

a seat panel integrally formed with said first panel and structurally separate from said second and third panels, a respective hinge line extending between each of said first panel top edge lateral ends and said seat panel, said seat panel being disposed in a substantially horizontal orientation over said base while in use and being pivotable around said hinge lines to a substantially vertical orientation so as to be co-planar with said first panel when the chair is to be folded;

first and second flange portions which are located on a respective side of said base first panel, said first and second flange portions being disposed at opposing angles to the remainder of said first panel and being separated therefrom along respective fold lines; and, first and second hinge-like triangular sections integral with said seat panel and said first and second flange portions and structurally separate from said second and third panels, one hinge-like section being positioned between an edge of each of said first panel flange portions and an adjacent edge of said seat panel, each of said first and second hinge-like sections being separated from its adjacent flange portion along a respective first fold line and being separated from an adjacent edge of said seat panel along a respective second fold line.

16. The chair of claim 15 further comprising a spine portion located between said second and third panels for reinforcing the chair, said spine portion including a pair of flanges each of said flanges being integral with a respective one of said adjacent sides of said second and third base panels and attached to one another in an overlying relationship and extending away from said second and third panels at an angle approximately transverse to a plane parallel to the front panel.

17. The chair of claim 16 further comprising a reinforcing member which is secured to said spine portion and wherein a flange portion of said reinforcing member is secured between said spine portion outwardly extending flanges and extends above the rest of said reinforcing member and said seat panel when said seat panel is disposed in said substantially horizontal orientation.

18. The chair of claim 15 further comprising a reinforcing member which includes first, second, and third substantially upright panels, said first and second panels being disposed in a diverging relationship to each other such that each panel constitutes one leg of a V, said third panel being integrally formed with and hingedly connected to one lateral edge of each of said first and second panels, said first and second panels being secured to each other along their other lateral edge and being secured along said edge to said base.

19. The chair of claim 18 wherein said base, said seat panel and said seat reinforcing member are integral and are defined by a single pre-stamped and scored blank.

20. The seat of claim 15 wherein said seat panel is hinged only from said pair of front panel flange portions and is separated from the remainder of said front panel by a slot.

21. A collapsible seat of stiff sheet material or the like, comprising:

a base member comprised of a plurality of substantially vertically disposed panels including a front panel and a pair of side panels such that said base member has a substantially triangular cross section, said front panel being integrally formed with said side panels;

a spine portion along which said base member side panels are joined to each other, said spine portion including a pair of flanges each of which is integral with one of said side panels and which are secured to each other in an overlying relationship and extend away from said base member, said flanges also extending approximately transversely to a plane parallel to said front panel;

a seat panel integrally formed with and hinged from a top edge of said front panel, wherein said seat panel can be disposed in a substantially horizontal orientation over said base member for use and in a substantially vertical orientation when pivoted around said front panel to allow the seat to be folded, said seat panel having a central hinge line extending from adjacent said front panel to adjacent said spine portion, wherein said seat panel can be folded into two complimentary halves around said hinge line when the seat is folded; and, a seat reinforcing member which extends underneath and supports at least a portion of said seat panel when said seat panel is in said substantially horizontal orientation, said seat reinforcing member being secured to one of said base member and said spine portion.

22. The seat of claim 21 wherein the material is a paperboard material.

23. The seat of claim 21 wherein the material is a plastic material.

24. The seat of claim 21 wherein said base member front panel includes a pair of opposing flange portions which are integral with said seat panel and are separated therefrom along a fold line which is angled with respect to the horizontal.

25. The seat of claim 21 further comprising a pair of lower back support panels, one being integrally formed with each of said base portion side panels.

26. The seat of claim 21 wherein said seat reinforcing member comprises first, second and third upright panels which are hingedly connected to each other, said third panel being hinged along its middle so that it can be folded into two complimentary halves when the seat is folded.

27. The seat of claim 26 further comprising a plurality of space slots provided in said base member front panel and said reinforcing member third panel, said slots being adapted to cooperate with an associated plastic bag to hold objects such as soft drinks and ice inside the seat base portion.

28. The seat of claim 21 wherein said seat reinforcing member comprises first and second upright members having sections which are of a height substantially equal to the height at which said seat panel will be situated when in its substantially horizontal orientation, said first and second upright member sections supporting said seat panel.

29. The seat of claim 21 further comprising a pair of handle apertures provided adjacent fold lines defining said base portion front and side panels so that the seat can be easily gripped when it is folded.

30. The seat of claim 21 wherein the collapsible seat is formed from a single pre-stamped and scored blank defining a unitary structure.

31. A method of collapsing a foldable article of furniture which is in its unfolded state, comprising:

providing a chair including a base, having a plurality of substantially vertically disposed panels including a front panel and a pair of side panels, and a seat panel which is disposed in a substantially horizontal orientation over said base when in use, said seat panel being hinged from said base at least along a pair of spaced hinge-like sections each of which is defined by a pair of hinge lines, a first hinge line extending between said seat panel and said hinge-like section and a second hinge line extending between one of said front panel and side panels of said base and said hinge-like section;

pivoting said seat panel around said pair of hinge-like sections to a substantially vertical orientation;

urging said seat panel and said base member front panel toward a rear section of said chair;

folding said seat member into two complimentary halves;

folding said base member front panel into two complimentary halves; and, urging said pair of side panels toward each other to enclose said front panel two complimentary halves between said side panels.

32. The method of claim 31 further comprising the steps of:

providing a seat reinforcing member in said chair base; and, folding said seat reinforcing member into two complimentary halves simultaneously with said steps of folding said seat member and folding said base member front panel, said seat reinforcing member complimentary halves being sandwiched between said base member side panels and said base member front panel complimentary halves during said step of urging said pair of side panels.

33. The method of claim 31 further comprising the step of providing a back support member secured to each of said base member pair of said panels, said seat member complimentary halves becoming positioned between said back support members during said step of urging said pair of side panels.

34. The method of claim 31 further comprising the steps of:

providing at least one handhold aperture in said chair; and, grasping said chair after said step of urging said pair of said panels by said at least one handhold aperture for easy transport.

* * * * *